US010460858B2

(12) United States Patent
Khatri et al.

(10) Patent No.: US 10,460,858 B2
(45) Date of Patent: Oct. 29, 2019

(54) CAPS FOR POWER DISTRIBUTION SYSTEM COMPONENTS

(71) Applicant: Hubbell Incorporated, Shelton, CT (US)

(72) Inventors: Mohamed Fayaz Khatri, Macedonia, OH (US); Austen William Rau, Cuyahoga Falls, OH (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 15/950,376

(22) Filed: Apr. 11, 2018

(65) Prior Publication Data

US 2018/0301252 A1 Oct. 18, 2018

Related U.S. Application Data

(60) Provisional application No. 62/485,492, filed on Apr. 14, 2017.

(51) Int. Cl.

| | |
|---|---|
| ***H01C 1/084*** | (2006.01) |
| ***H01C 7/12*** | (2006.01) |
| ***H01C 1/028*** | (2006.01) |
| ***H01C 1/02*** | (2006.01) |
| *H01T 4/04* | (2006.01) |

(52) U.S. Cl.

CPC ..... *H01C 1/02* (2013.01); *H01C 1/028* (2013.01); *H01C 1/084* (2013.01); *H01C 7/12* (2013.01); *H01T 4/04* (2013.01)

(58) Field of Classification Search

CPC ..... H01C 1/02; H01C 1/084; H01C 7/12

See application file for complete search history.

(56) References Cited

U.S. PATENT DOCUMENTS

| | | | | |
|---|---|---|---|---|
| 2,454,849 | A | 11/1948 | Stroup | |
| 2,756,367 | A | 7/1956 | Baker | |
| 3,798,505 | A | 3/1974 | Reckyard et al. | |
| 4,851,955 | A * | 7/1989 | Doone | H01C 7/12 361/117 |
| 4,985,599 | A | 1/1991 | Eggleston | |
| 4,992,906 | A * | 2/1991 | Doone | H01C 7/12 361/117 |
| 5,566,056 | A | 10/1996 | Chaudhry | |
| 5,903,427 | A | 5/1999 | Roby | |
| 6,018,453 | A | 1/2000 | Daharsh et al. | |
| 7,009,102 | B2 | 3/2006 | Milner | |
| D670,253 | S | 11/2012 | Strong et al. | |
| 8,633,391 | B2 | 1/2014 | Strong et al. | |
| 9,337,646 | B2 | 5/2016 | Sulitze | |
| 9,847,633 | B2 | 12/2017 | Lenk et al. | |

(Continued)

OTHER PUBLICATIONS

ZForce(TM) Distribution Arrester EZ Ordering Information Brochure May 2010.

(Continued)

*Primary Examiner* — Kyung S Lee

(74) *Attorney, Agent, or Firm* — Wissing Miller LLP

(57) ABSTRACT

The present disclosure provides embodiments of power distribution system components, such as arresters, isolators, bushings, and fuses that include one or more end caps that have predefined heat resistant characteristics that can withstand high temperatures without melting, flowing or generating sparks when subject to such high temperatures.

26 Claims, 6 Drawing Sheets

(56) References Cited

U.S. PATENT DOCUMENTS

| | | | | |
|---|---|---|---|---|
| 2005/0073779 | A1 | 4/2005 | Milner | |
| 2010/0118463 | A1* | 5/2010 | Smith | H01C 7/126 361/117 |
| 2012/0320552 | A1 | 12/2012 | Strong et al. | |
| 2013/0112458 | A1 | 5/2013 | Gautier | |
| 2016/0133360 | A1 | 5/2016 | Lenk et al. | |

OTHER PUBLICATIONS

"Superior Protection for Arresters and Wildlife", Eaton's Cooper Power Systems Business, 2014.

International Search Report and Written Opinion mailed in corresponding PCT/US18/27036 dated Jun. 19, 2018.

* cited by examiner

Fig. 6
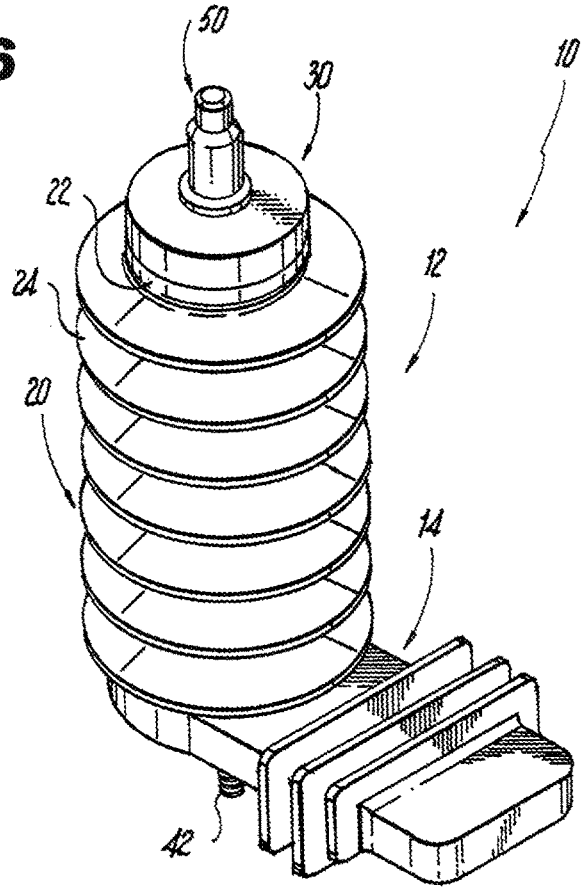
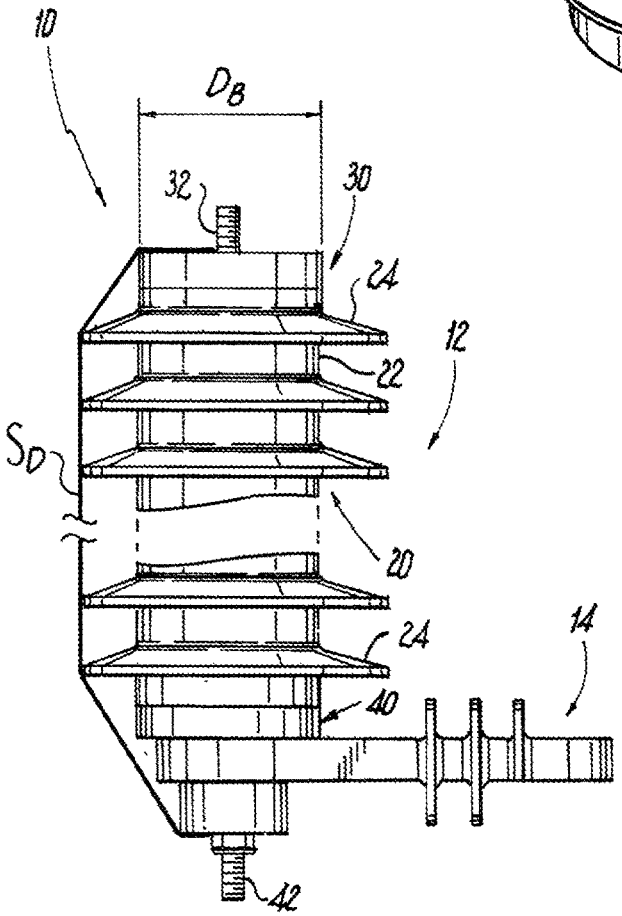
Fig. 7

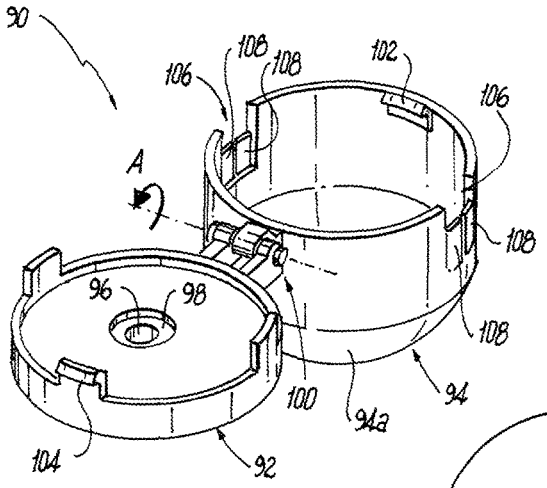
Fig. 11
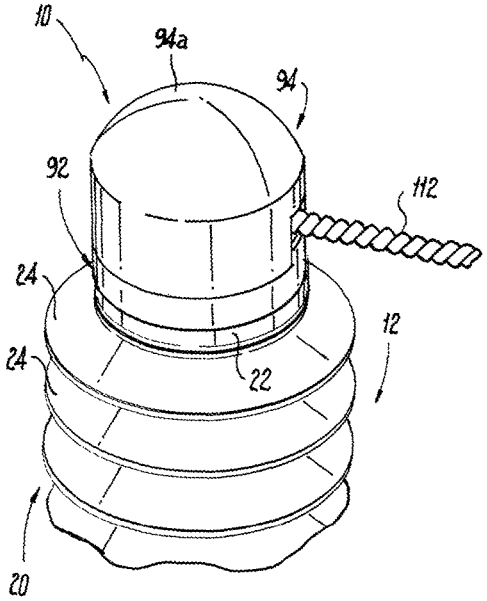
Fig. 13
Fig. 12
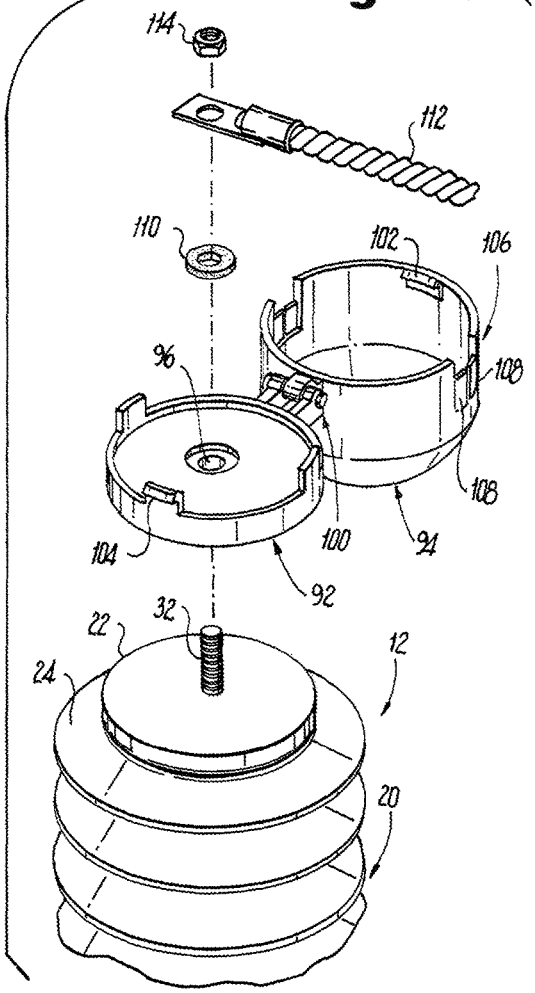

CAPS FOR POWER DISTRIBUTION SYSTEM COMPONENTS

CROSS REFERENCE TO RELATED APPLICATIONS

The present application is based on and claims benefit from U.S. Provisional Application Ser. No. 62/485,492 filed Apr. 14, 2017 entitled "Caps for Power Distribution System Components" the entire contents of which are incorporated herein in its entirety by reference.

BACKGROUND

Field

The present disclosure relates generally to arresters, isolators, bushings and other equipment and components used in power distribution systems. More particularly, the present disclosure relates to end caps for such power distribution system components that have predefined heat resistant characteristics that can withstand high levels of heat that may be generated by such components.

Description of the Related Art

Power distribution systems use power generation stations and substations as part of the overall electrical generation, transmission, and distribution system. Power generation stations typically generate high voltage electrical power for transmission to substations that distribute the electrical power to consumers. A substation may include transformers to change voltage levels between high transmission voltages and lower distribution voltages, or that change the voltage at the interconnection of two different transmission voltages. Between a power generating station and consumers, electric power may flow through several substations at different voltage levels. On the consumer side of the overall electrical generation, transmission, and distribution system, transformers are used to step down the voltage on the power lines for customer usage.

Power distribution systems include a number of components and equipment to deliver electrical power to consumers, including components such as arresters, isolators, bushings and fuses. The purpose of a surge arrester, for example, is to divert damaging over-voltage transients (i.e., surges) caused by lightning or switching events, safely to ground, thereby protecting the transformer or other system equipment and components from damage. One form of current surge arresters typically includes a tubular insulator housing having a hollow core, a connection for a high voltage line on one end cap of the housing, a connection for grounding the arrester to the earth ground on another end cap of the housing, and active parts within the hollow core of the tubular housing between the line and ground connections. The end caps are metallic plates.

The tubular design of substation surge arresters incorporate an annular gas-gap between the active parts within the hollow core and the insulator housing. During operation, if lightning strikes or if a switching event occurs, the arrester may build up pressurized gas that is heated often to high temperatures within the hollow core of the housing by heat generated from a lightning strike arc or a switching event arc. To relieve such gas pressure within the hollow core of the housing, such tubular arresters typically have a pressure relief system that opens when the internal pressure reaches a predefined threshold. Typically, such heated gas is vented through the ends of the tubular housing where the end caps are located.

As a precautionary measure, having end caps made of a heat resistant material may minimize collateral hazards that may results with metal end caps.

SUMMARY

The present disclosure provides embodiments of power distribution system components having at least one end cap made of a heat resistive material having a burning or melting point sufficient to withstand temperatures of 1400° F. or greater. In one exemplary embodiment, the power distribution system component includes a housing, a first end cap and a second end cap. The housing may comprise a tubular body having a hollow core, a first end with a first electrical terminal and a second end with a second electrical terminal. In another embodiment, the housing may comprise a tubular body having a hollow core and a plurality of fins extending radially outward from the tubular body. The first end cap is disposed at the first end of the housing and is made of a heat resistive material that may soften when subject to high levels of heat but does not melt, flow or generate sparks when subject to high levels of heat for a predetermined period of time. The second end cap is disposed at the second end of the housing. The second end cap may be made of a heat resistive material that may soften when subject to high levels of heat but does not melt, flow or generate sparks when subject to high levels of heat for a predetermined period of time. The second end cap is disposed at the second end of the housing. In this exemplary embodiment, an insulating cover may be releasably secured to the first electrical terminal to prevent contact with the electrical terminal.

In another exemplary embodiment, the power distribution system component includes a housing, a first end cap and a second end cap. In this exemplary embodiment, the housing may comprise a tubular body having a hollow core, a first end with a first electrical terminal and a second end with a second electrical terminal. In another embodiment, the housing may comprise a tubular body having a hollow core and a plurality of fins extending radially outward from the tubular body, a first end with a first electrical terminal and a second end with a second electrical terminal. A first end cap is disposed at the first end of the housing. The first end cap comprises a base and a cover removably attached to the base. For example, the cover may be pivotally secured to the base. The first end cap is made of a heat resistive material that may soften when subject to high levels of heat but does not melt, flow or generate sparks when subject to high levels of heat for a predetermined period of time. A second end cap is disposed at the second end of the housing.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein:

FIG. 6 is a perspective view of another exemplary embodiment of an arrester assembly according to the present disclosure, illustrating a heat resistant end cap disposed on an upper end of an arrester and an insulating cover over an electrical terminal of the arrester;

FIG. 7 is a side elevation view of another exemplary embodiment of an arrester assembly according to the present disclosure, illustrating a first heat resistant end cap disposed on an upper end of an arrester and a second heat resistant end cap disposed on a lower end of the arrester;

FIG. 11 is a top perspective view of another exemplary embodiment of a heat resistant end cap according to the present disclosure;

FIG. 12 is a top perspective view with parts separated of another exemplary embodiment of an arrester assembly according to the present disclosure, illustrating the heat resistant end cap of FIG. 11 disposed on an arrester and in an open position; and FIG. 13 is a top perspective view of the arrester assembly of FIG. 12, illustrating the heat resistant end cap in a closed positioned.

DETAILED DESCRIPTION

The present disclosure provides embodiments of power distribution system components having an end cap made of a heat resistive material having a burning or melting point sufficient to withstand temperatures of 1400° F. or greater. For the present disclosure examples of power distribution system components include arresters, isolators, bushings and fuses. For ease of description, the embodiments of the present disclosure are described in relation to an arrester as the power distribution system component, however, the disclosure also contemplates using any power distribution system component.

Figure 1:
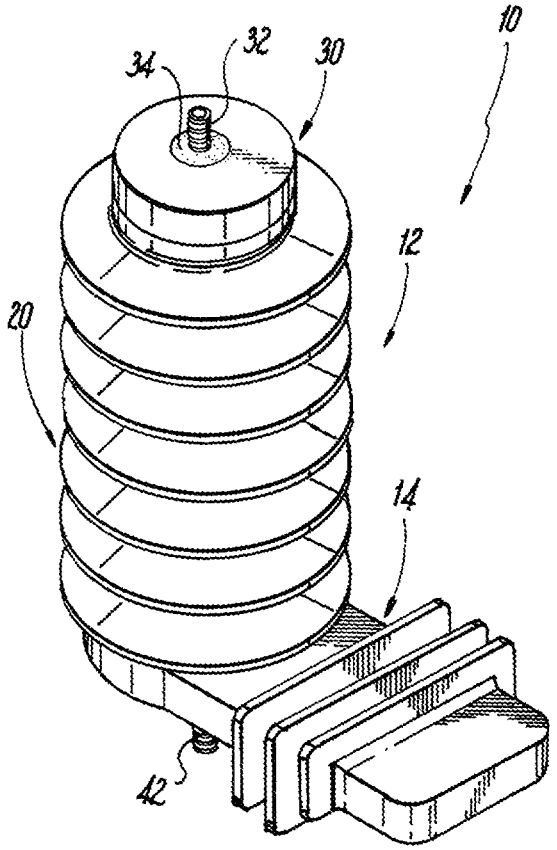
FIG. 1 is a perspective view of an exemplary embodiment of an arrester assembly according to the present disclosure, illustrating an exemplary embodiment of a heat resistant end cap disposed on an upper end of an arrester.
Figure 2:
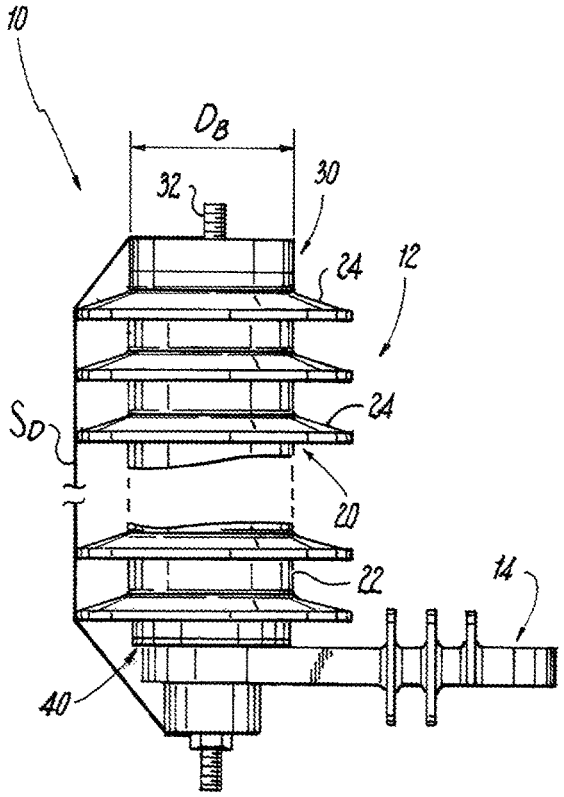
FIG. 2 is a side elevation view of the arrester assembly of FIG. 1, illustrating a strike distance.

Referring to FIGS. 1 and 2, an exemplary embodiment of an arrester assembly according to the present disclosure is provided. In this exemplary embodiment, the arrester assembly 10 includes an arrester 12 and an insulating bracket 14. The insulating bracket 14 has one end connected to the arrester 12 and the other end is typically connected to a mounting bracket (not shown) used to secure the arrester to a structure. The arrester 12 includes a housing 20. The housing 20 is preferably made of an insulating material, typically porcelain or a polymer material such as thermoplastic or silicone. The housing 20, in this exemplary embodiment, has a tubular body 22 with a hollow core and one or more fins or sheds 24 positioned along the body and that extend from the body. The fins 24 can be integrally formed into the body 22 or secured to the body using welds, adhesives or mechanical fasteners. The hollow core of the body 22 typically includes the active components of the arrester, such as for example a plurality of metal oxide non-linear resistor blocks stacked one on top of the other. The tubular body 22 has a diameter "$D_B$" and the fins 24 are preferably tapered away from the body to permit water and ice to be drawn away from the body. The fins 24 also facilitate the dissipation of heat that may build-up in the hollow core of the body 22. It should be noted that the present disclosure contemplates numerous other shapes and sizes for the housing 20 as is known.

Continuing to refer to FIG. 2, covering the upper end of the hollow core of the body 22 is an end cap 30 and covering the lower end of the hollow core of the body is an end cap 40. An electrical terminal 32 extends through the end cap 30 and the area between the end cap and the electrical terminal is sealed with a gasket 34. An electrical terminal 42 extends through the end cap 40 and the area between the end cap and the electrical terminal is sealed with a gasket. The electrical terminals 32 and 42 are operatively connected to active components within the hollow core of the body 20. When installed, the upper electrical terminal 32 is used to connect the arrester 12 to a power line, such as a high voltage line, and the lower electrical terminal 42 is used to connect the arrester 12 to a ground conductor. In the embodiment of FIGS. 1 and 2, the end cap 40 is a stainless-steel plate, aluminum plate or other metallic plate as is known in the industry. The end cap 40 protects the insulating bracket 14 from surface tracking, which can occur when the arrester 12 is energized in a contaminated environment, such as when the air is contaminated with high levels of salt or other contaminants that can corrode the insulating bracket 14.

Figure 3:
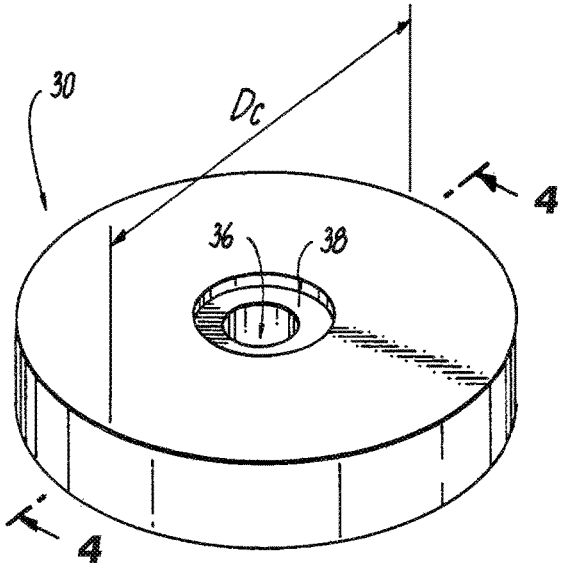
FIG. 3 is a top perspective view of an exemplary embodiment of a heat resistant end cap according to the present disclosure.
Figure 4:
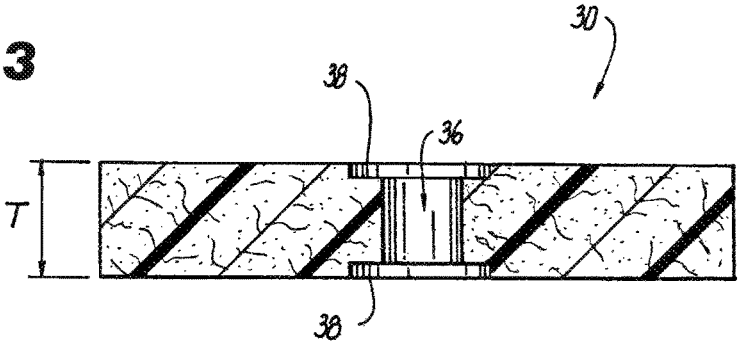
FIG. 4 is a cross-sectional view of the heat resistant end cap of FIG. 3 taken along line 4-4.
Figure 5:
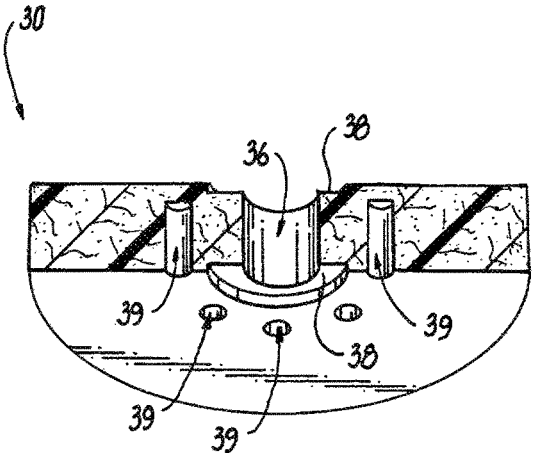
FIG. 5 is a cross-sectional perspective view of the underside of another exemplary embodiment of the heat resistant end cap according to the present disclosure.

Turning now to FIGS. 3-5, the end cap 30 may come in numerous shapes and sizes. As noted above, the end cap 30 is made of a material having a burning or melting point sufficient to withstand temperatures of 1400° F. or greater. More specifically, in the embodiment shown, the end cap 30 is made of a material that may soften when subject to high levels of heat but does not melt, flow or generate sparks when subject to high levels of heat for a predetermined period of time. For ease of description, such material will be referred to herein as the heat resistant material. Thus, the heat resistant material according to the present disclosure is able to withstand high temperatures for at least a predetermined period of time such that the heat resistant material does not melt, flow or generate sparks. As an example, the high level of heat the heat resistant material should be able to withstand includes temperatures in the range from about 1500° F. to about 2000° F. Further, the heat resistant material should be able to withstand such temperatures for a period of time of at least 2 seconds. A non-limiting example of such heat resistant material is fiberglass filled thermoset epoxy resin. The heat resistant materials contemplated by the present disclosure include non-metallic materials, metallic materials and/or combinations of metallic and non-metallic materials. The heat resistant materials contemplated by the present disclosure may also be non-conductive materials, semi-conductive materials and/or conductive materials. For ease of description, non-metallic and/or metallic, non-conductive heat resistant materials may also be referred to as "non-conductive heat resistant materials" in the plural and "non-conductive heat resistant material" in the singular. The non-metallic and/or metallic, semi-conductive heat resistant materials may also be referred to as the "semi-conductive heat resistant materials" in the plural and the "semi-conductive heat resistant material" in the singular. The non-metallic and/or metallic, conductive heat resistant materials may also be referred to as the "conductive heat resistant materials" in the plural and the "conductive heat resistant material" in the singular.

Non-conductive heat resistant materials contemplated by the present disclosure do not conduct electricity. Non-conductive heat resistant materials allow leakage current to flow along the surface of the cap 30. Non-limiting examples of non-conductive heat resistant materials include fiberglass filled thermoset epoxy resin, insulating ceramic materials, glass materials, porcelain and other composite materials. Semi-conductive heat resistant materials contemplated by the present disclosure are materials whose electrical conductivity is intermediate between that of an electrically conductive metal and an insulator. Semi-conductive heat resistant materials allow leakage current to flow through the body of the cap 30 as well as along the surface of the cap 30 to better prevent tracking. Non-limiting examples of semi-conductive heat resistant materials include fiberglass filled thermoset epoxy resin with a carbon black filler. As a non-limiting example, the amount f carbon black filler in the fiberglass filled thermoset epoxy resin may be in the range from about 1 percent and about 3 percent. Preferably, the percentage of amount of carbon black filler in the fiberglass filled thermoset epoxy resin is about 1.6 percent. Conductive heat resistant materials contemplated by the present disclosure are materials that can conduct electricity similar to electrically conductive metals. Conductive heat resistant materials also allow leakage current to flow through the body of the cap 30 as well as along the surface of the cap 30 to better prevent tracking. Non-limiting examples of conductive heat resistant materials include graphite, electrically conductive ceramics, high temperature metal alloys, such as tungsten and nickel, and metal and ceramic composites.

As shown in FIGS. 3 and 4, the end cap 30 is in this exemplary embodiment a cylindrical shaped member having a diameter "De" and a thickness "T." The diameter $D_C$ of the end cap 30 may be equal to the diameter $D_B$ of the body 22 of the housing 20, greater than the diameter of the body or less than the diameter of the body. As shown in FIGS. 2, 6 and 7, the diameter $D_C$ of the end cap 30 is equal to the diameter $D_B$ of the body 22. The diameter and thickness of the end cap 30 is configured and dimensioned so that the end cap is capable of withstanding the temperatures set forth above for the duration set forth above. Preferably, the diameter of the end cap 30 is in the range from about 30 mm and about 70 mm, and the thickness T of the end cap is in the range from about 0.3 inches and about 0.6 inches. As seen in FIG. 4, the end cap 30 includes a center aperture 36 through which the electrical terminal 32 or 42 can pass through the end cap 30. Around the center aperture 36 on both sides of the end cap 30 are recess portions 38 in which the gasket 34 used to seal the area around the electrical terminal 32 or 42 can fit. Referring to FIG. 5, another exemplary embodiment of the end cap 30 is shown. In this exemplary embodiment, the end cap 30 includes a plurality of cavities 39 around the perimeter of the recesses 38 in an underside of the end cap 30. The cavities 39 are provided to reduce the material used to manufacture the end caps 30 while maintaining its tolerance to heat, melting and sparking as described herein and waterproof seal.

In addition to having the ability to withstand high temperatures as described herein, having an end cap 30 made of the non-conductive heat resistant material increases the strike distance "$S_D$" between the high voltage end point, e.g., electrical terminal 32, and the low voltage end point, e.g., electrical terminal 42, on the arrester 12, seen in FIG. 2. The strike distance, which may also be referred to as the dry arc distance, and the surface characteristics of the housing 20 determine the insulation withstand of the arrester.

Figure 2A:
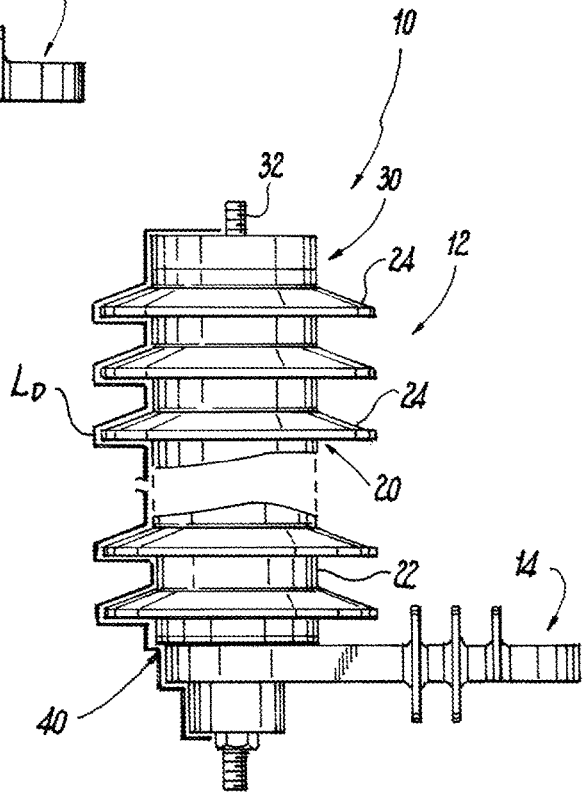
FIG. 2A is a side elevation view of the arrester assembly of FIG. 1, illustrating a leakage distance.

In addition to having the ability to withstand high temperatures as described herein, having an end cap 30 made of the non-conductive heat resistant material also increases the leakage distance "$L_D$" between the high voltage end point, e.g., electrical terminal 32, and the low voltage end point, e.g., electrical terminal 42, on the arrester 12, seen in FIG. 2A. The leakage distance, which may also be referred to as the creepage distance, helps to minimize the effects of flashover on the power distribution system.

Referring now to FIG. 6, another exemplary embodiment of an arrester assembly according to the present disclosure is provided. In this exemplary embodiment, the arrester assembly 10 is substantially the same as the arrester assembly of FIGS. 1 and 2, except that the arrester assembly also includes an insulating cover 50. Thus, the arrester assembly of this exemplary embodiment includes an arrester 12, an insulating bracket 14, both described above, and the insulating cover 50. The insulating cover 50 according to the present disclosure is configured and dimensioned to attach directly over an electrical terminal (e.g., electrical terminal 32) with, for example, a press fit or an interference fit, where an inner surface of the insulating cover 50 is adjacent to an outer surface the electrical terminal. With a press fit, when the insulating cover 50 is pushed over the electrical terminal the friction between the electrical terminal and the inner surface of the insulating cover 50 holds the insulating cover in place. The insulating cover 50 according to the present disclosure is fabricated with an insulating material capable of insulating conductive components in high voltage environments, such as system voltages ranging from about 2.55 kV to about 38 kV. Preferably, the insulating material has a thickness from about 0.05 inches to about 0.15 inches, and preferably about 0.09 inches to provide sufficient rigidity to withstand movement that may be caused by wildlife perched on the insulating cover 50. It is also preferred to use an insulating material that has flame resistant properties that meet the UL 94 Test Method, and preferably the V-0 criteria of the UL 94 Test Method. Examples of materials that may be used to fabricate the insulating covers include, a UV stabilized low density polyethylene or a thermoplastic vulcanizate, such as Santoprene.® However, other known electrically insulating materials may be used. However, the insulating cover 50 may be made of the heat resistant material described herein.

Referring to FIG. 7, another exemplary embodiment of an arrester assembly according to the present disclosure is provided. In this exemplary embodiment, the arrester assembly 10 may be substantially the same as the arrester assembly of FIGS. 1 and 2, except that the metallic lower end cap 40 is replaced with an end cap made of the same heat resistant material as the end cap 30. The heat resistant materials contemplated for cap 40 may also be the non-conductive heat resistant materials, semi-conductive heat resistant materials and/or conductive heat resistant materials described above for cap 30. The heat resistant materials contemplated for cap 40 may also include non-metallic materials, metallic materials and/or combinations of metallic and non-metallic materials described herein. In addition to having the ability to withstand high temperatures as described herein, having both end caps 30 and 40 made of non-conductive heat resistant material further increases the strike distance "$S_D$" between the high voltage end point, e.g., electrical terminal 32, and the low voltage end point, e.g., electrical terminal 42, on the arrester 12. In addition to having the ability to withstand high temperatures as described herein, having both caps 30 and 40 made of non-conductive heat resistant material also increases the leakage distance "$L_D$" between the high voltage end point, e.g., electrical terminal 32, and the low voltage end point, e.g., electrical terminal 42, on the arrester 12. In another exemplary embodiment, the arrester assembly may include an arrester having an end cap 30 and an end cap 40 both made of the heat resistant material described herein. In this exemplary embodiment, the arrester assembly the arrester does not include the insulating bracket 14.

Figure 8:
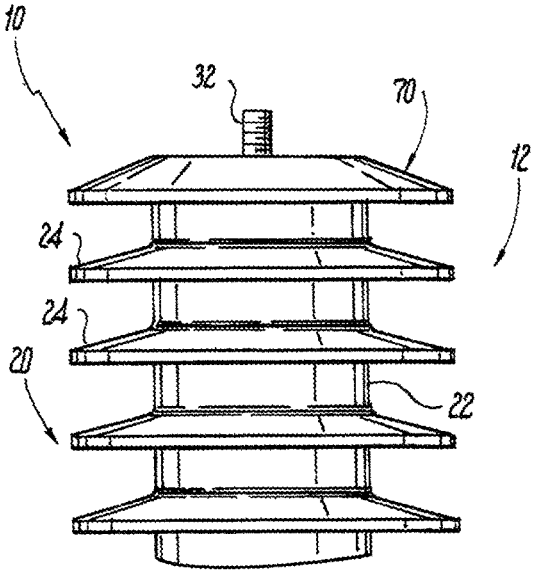
FIG. 8 is a side elevation view of another exemplary embodiment of an arrester assembly according to the present disclosure, illustrating another exemplary embodiment of a heat resistant end cap disposed on an upper end of an arrester.
Figure 9:
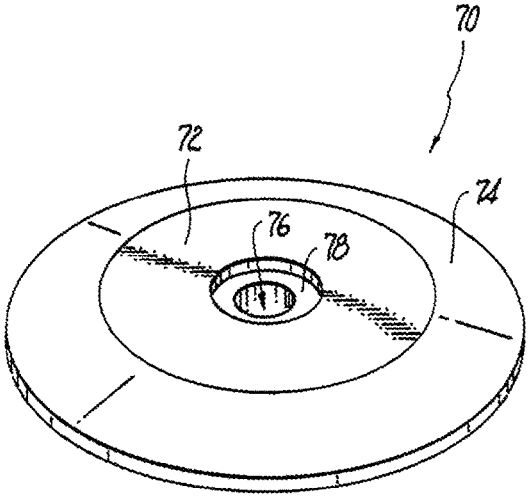
FIG. 9 is a top perspective view of the heat resistant end cap of FIG. 8.
Figure 10:
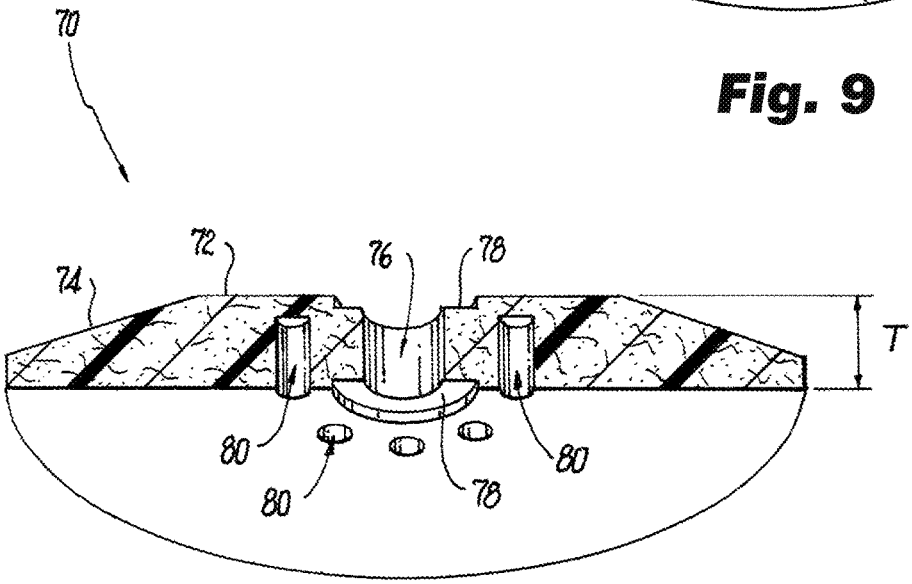
FIG. 10 is a perspective view of the underside of another exemplary embodiment of the heat resistant end cap of FIG. 8.

Referring now to FIGS. 8-10, another exemplary embodiment of the end cap according to the present disclosure is shown. In this exemplary embodiment, end cap 70 includes a base portion 72 and a fin portion 74. In this exemplary embodiment, the base portion 72 is similar in size and dimension as the end cap 30 described above, and the fin portion 74 is shaped in a similar manner as the fins 24 extending from the body 22 of the housing 20. Similar to the end cap 30, the end cap 70 is made of the heat resistant material described above, such that the end cap 70 is able to withstand high temperatures for at least a predetermined period of time such that the heat resistant material does not melt, flow or generate sparks. The heat resistant materials contemplated for cap 70 may also be the non-conductive heat resistant materials, semi-conductive heat resistant materials and/or conductive heat resistant materials described above for cap 30. The heat resistant materials contemplated for end cap 70 may also include non-metallic materials, metallic materials and/or combinations of metallic and non-metallic materials described herein. The diameter and thickness of the base portion 72 of the end cap 70 is configured and dimensioned so that the end cap is capable of withstanding the temperatures set forth above for the duration set forth above. Preferably, the diameter of the base portion 72 is in the range from about 30 mm and about 50 mm, and the thickness T of the base portion 72 is in the range from about 0.3 inches and about 0.6 inches. As seen in FIG. 9, the base portion 72 of the end cap 70 includes a center aperture 76 through which the electrical terminal 32 or 42 can pass. Around the center aperture 76 on one or both sides of the end cap 70 is a recess portions 78 in which the gasket 34 used to seal the area around the electrical terminal 32 or 42 can fit. Referring to FIG. 10, another exemplary embodiment of the end cap 70 is shown. In this exemplary embodiment, the end cap 70 includes a plurality of cavities 80 around the perimeter of the recesses 78 in the underside of the base portion 72. The cavities 80 are provided to reduce the material used to manufacture the end caps 70 while maintaining its tolerance to heat, melting and sparking as described herein and waterproof seal.

Turning to FIGS. 11-13, another exemplary embodiment of an end cap made of the heat resistant material included with the arrester assembly 10 is shown. In this exemplary embodiment, the end cap 90 has base 92 and a cover 94 removably secured to the base 92. The base 92 is a cylindrical shaped member that includes a center aperture 96 through which the electrical terminal 32 or 42 can pass. Around the center aperture 96 on at least one side of the base 92 is a recess portion 98 in which a gasket 110 used to seal the area around the electrical terminal 32 or 42 can fit. The cover 94, in this exemplary embodiment, is pivotably secured to the base 92 with a hinge assembly 100 as shown, and a latching mechanism that includes latch arm 102 extending toward the center of the cover 94 and latch receiving member 104 on the base 92. When the cover 94 is moved from the open position, seen in FIG. 11, to the closed position, i.e., pivoted in the direction of arrow A, to enclose the base, the latch arm 102 interlocks with the latch receiving member 104 to releasable secure the cover to the base. The cover 94 is a cylindrical structure having an open center portion and a dome 94*a* that is sufficient to enclose the electrical terminal, e.g., electrical terminal 32, when the cover is in the closed position. The cover 94 also includes one or more openings 106 through which a wire, such as a high voltage wire or ground wire, attached to the electrical terminal 32 or 42 can pass through the cover. The opening 106 can include one or more detachable members 108 that can be detached from the cover 94 to allow one or more wires to pass through the cover. Any unused openings 106 can remain substantially sealed. It is noted that the shape and dimensions of the cover may vary depending upon the power distribution system component it is to be associated with and the size and dimensions of the electrical terminal to be covered by the cover.

As noted, the end cap 90 is made of the heat resistant material described above for cap 30. Thus, the heat resistant materials contemplated for cap 90 may also be non-conductive heat resistant materials, semi-conductive heat resistant materials and/or conductive heat resistant materials described above for cap 30. The heat resistant materials contemplated for cap 90 may also include non-metallic materials, metallic materials and/or combinations of metallic and non-metallic materials described herein. More specifically, the end cap base 92, the end cap cover 94 and the hinge assembly 100 are made of a heat resistant material that may soften when subject to high levels of heat but does not melt, flow or generate sparks when subject to high levels of heat for a predetermined period of time. As noted above, an example of the high level of heat the heat resistant material should be able to withstand includes temperatures in the range from about 1500° F. to about 2000° F. Further, the heat resistant material should be able to withstand such temperature for a period of time of at least 2 seconds.

Referring to FIGS. 12 and 13, the connection of the end cap 90 to an arrester 12 is shown. The end cap 90 is positioned over an end of the arrester 12 so that an electric terminal, here electrical terminal 32, passes through the center opening 96 in the base 92 of the end cap. A gasket 110 is then slid onto the electrical terminal 32 until it rests within the recess 98 in the base 92 of the end cap 90. A wire conductor 112, e.g., a high voltage wire or ground wire, is then attached to the electrical terminal 32 using nut 114 threaded onto the electrical terminal. The detachable members 108 in one opening 106 are then removed and the cover 94 is pivoted onto the base 92, as seen in FIG. 13. The cover is releasably secured to the base via the latching mechanism as described above. With the cover 94 releasably secured to the base 92, the end cap 90 provides its heat resistant function while also preventing wildlife from contacting the electrical terminal 32.

It should be noted that the type and size of the arrester 12 included in the arrester assembly 10 of the present disclosure is dependent upon a number of factors, including the power conditions, e.g., the voltage and current, for which the arrester assembly will be used. The type and size of the insulating bracket 14 included in the arrester assembly 10 of the present disclosure is dependent upon a number of factors, including the structure the arrester assembly will be attached to, the arrester breaking load and the final desired creepage of the arrester assembly, as is known in the art. For example, the insulating brackets 14 may come in different sizes, such as short, medium and long. Arresters 12 and insulating brackets 14 contemplated for the present disclosure are standard arresters and insulating brackets used in the power distribution industry. It should also be noted that the present disclosure also contemplates arresters or other power distribution system components that do not include insulating brackets.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A power distribution system component comprising:

a housing having a first end and a second end, wherein a first electrical terminal extends from the first end and a second electrical terminal extends from the second end;

a first end cap disposed at the first end of the housing, the first end cap being a substantially solid structure from a center aperture of the first end cap to an outer wall of the first end cap, the first end cap being made of a heat resistive material that softens when subject to high levels of heat but does not melt, flow or generate sparks when subject to high levels of heat for a predetermined period of time; and a second end cap disposed at the second end of the housing.

2. The power distribution system component according to claim 1 further comprising an insulating cover releasably secured to the first electrical terminal.

3. The power distribution system component according to claim 2, wherein the insulating cover is made of a heat resistive material that may soften when subject to high levels of heat but does not melt, flow or generate sparks when subject to high levels of heat for a predetermined period of time.

4. The power distribution system component according to claim 1, wherein the housing comprises a tubular body having a hollow core.

5. The power distribution system component according to claim 1, wherein the housing comprises a tubular body having a hollow core and a plurality of fins extending radially outward from the tubular body.

6. The power distribution system component according to claim 1, wherein the first end cap comprises a cylindrical shaped member having a center aperture to permit the first electrical terminal to pass through the first end cap.

7. The power distribution system component according to claim 1, wherein the first end cap comprises a base portion and a fin portion extending from the base portion.

8. The power distribution system component according to claim 7, wherein the base portion comprises a cylindrical shaped member and the fin portion extending from the base portion comprises a cylindrical shaped member.

9. The power distribution system component according to claim 1, wherein the first end cap comprises a base and a cover removably attached to the base.

10. The power distribution system component according to claim 9, wherein the cover is pivotally secured to the base.

11. The power distribution system component according to claim 9, wherein the base comprises a cylindrical shaped member having a center aperture to permit the first electrical terminal to pass through the base.

12. The power distribution system component according to claim 9, wherein the cover comprises a cylindrical shaped member having a central opening capable of enclosing the first electrical terminal passing through the base when the cover is in a closed position.

13. The power distribution system component according to claim 9, wherein the cover comprises a dome.

14. The power distribution system component according to claim 1, wherein the second cap is made of a heat resistive material that may soften when subject to high levels of heat but does not melt, flow or generate sparks when subject to high levels of heat for a predetermined period of time.

15. The power distribution system component according to claim 14, wherein the second end cap comprises a cylindrical shaped member having a center aperture to permit the second electrical terminal to pass through the second end cap.

16. The power distribution system component according to claim 14, wherein the second end cap comprises a cylindrical shaped base portion and a fin portion extending from the base portion.

17. The power distribution system component according to claim 1, wherein the power distribution system component comprises an arrester.

18. A power distribution system component comprising:

a housing having a first end and a second end, wherein a first electrical terminal extends from the first end and a second electrical terminal extends from the second end;

a first end cap disposed at the first end of the housing, the first end cap having a base and a cover removably attached to the base, the base being a substantially solid structure from a center aperture of the base to an outer wall of the base, the first end cap is made of a heat resistive material that softens when subject to high levels of heat but does not melt, flow or generate sparks when subject to high levels of heat for a predetermined period of time; and a second end cap at the second end of the housing.

19. The power distribution system component according to claim 18, wherein the cover is pivotally secured to the base.

20. The power distribution system component according to claim 18, wherein the base comprises a cylindrical shaped member having a center aperture to permit the first electrical terminal to pass through the base.

21. The power distribution system component according to claim 18, wherein the cover comprises a cylindrical shaped member having a central opening capable of enclosing the first electrical terminal passing through the base.

22. The power distribution system component according to claim 21, wherein the cover comprises a dome.

23. The power distribution system component according to claim 18, wherein the second cap is made of a heat resistive material that may soften when subject to high levels of heat but does not melt, flow or generate sparks when subject to high levels of heat for a predetermined period of time.

24. The power distribution system component according to claim 23, wherein the second end cap comprises a cylindrical shaped member having a center aperture to permit the second electrical terminal to pass through the second end cap.

25. The power distribution system component according to claim 23, wherein the second end cap comprises a cylindrical shaped base portion and a fin portion extending from the base portion.

26. The power distribution system component according to claim 18, wherein the power distribution system component comprises an arrester.

* * * * *